US008857182B1

(12) United States Patent
Roper et al.

(10) Patent No.: US 8,857,182 B1
(45) Date of Patent: Oct. 14, 2014

(54) POWER GENERATION THROUGH ARTIFICIAL TRANSPIRATION

(75) Inventors: Christopher S. Roper, Malibu, CA (US); William B. Carter, Santa Monica, CA (US)

(73) Assignee: HRL Laboratories, LLC, Malibu, CA (US)

( * ) Notice: Subject to any disclaimer, the term of this patent is extended or adjusted under 35 U.S.C. 154(b) by 1056 days.

(21) Appl. No.: 12/783,551

(22) Filed: May 19, 2010

(51) Int. Cl.
*B60K 16/00* (2006.01)
*F01K 25/08* (2006.01)

(52) U.S. Cl.
USPC ..... 60/641.8; 60/651; 60/671; 290/1 R

(58) Field of Classification Search
USPC ..... 60/641.8–641.15, 649, 651, 671; 290/1 R
See application file for complete search history.

(56) References Cited

U.S. PATENT DOCUMENTS

| | | | | |
|---|---|---|---|---|
| 3,783,969 | A | 1/1974 | Pall | |
| 3,906,250 | A * | 9/1975 | Loeb | 290/1 R |
| 3,984,861 | A | 10/1976 | Kessler, Jr. | |
| 4,193,267 | A * | 3/1980 | Loeb | 60/649 |
| 4,452,046 | A * | 6/1984 | Valentin | 60/641.11 |
| 4,602,679 | A | 7/1986 | Edelstein et al. | |
| 4,673,402 | A | 6/1987 | Weisman et al. | 604/368 |
| 5,238,574 | A * | 8/1993 | Kawashima et al. | 210/652 |
| 5,248,079 | A | 9/1993 | Li | |
| 6,293,332 | B2 | 9/2001 | Li | |
| 6,868,898 | B2 | 3/2005 | Chau et al. | |
| 6,888,720 | B2 | 5/2005 | Pfister et al. | |
| 7,340,898 | B2 * | 3/2008 | Miller | 60/641.8 |
| 7,382,959 | B1 | 6/2008 | Jacobsen | 385/129 |
| 7,401,643 | B2 | 7/2008 | Queheillalt et al. | |
| 7,488,547 | B1 | 2/2009 | Iacovelli | |
| 7,513,997 | B2 | 4/2009 | Del Porto | |
| 7,687,132 | B1 | 3/2010 | Gross et al. | |
| 8,579,018 | B1 | 11/2013 | Roper | |
| 2002/0007201 | A1 | 1/2002 | Grahn | |
| 2005/0202206 | A1 | 9/2005 | Wadley et al. | |
| 2006/0162907 | A1 | 7/2006 | Wu et al. | |
| 2006/0163319 | A1 | 7/2006 | Ervin et al. | |
| 2006/0195179 | A1 | 8/2006 | Sun | |
| 2007/0068654 | A1 | 3/2007 | Chang | |
| 2007/0102140 | A1 | 5/2007 | Tuma et al. | |
| 2007/0107875 | A1 | 5/2007 | Lee et al. | |
| 2007/0163755 | A1 | 7/2007 | Kim et al. | |
| 2010/0157535 | A1 | 6/2010 | Oniki et al. | |
| 2010/0159398 | A1 | 6/2010 | Rock et al. | |
| 2010/0264656 | A1 * | 10/2010 | Flood | 290/52 |

OTHER PUBLICATIONS

"Fabricating three dimensional nanostructures using two photon lithography in a single exposure step" by Seokwoo Jeon, Viktor Malyarchuk, John A. Rogers, and Gary P. Wiederrecht published in *Optics Express*, vol. 14, issue 6, at pp. 2300-2308.

(Continued)

*Primary Examiner* — Hoang Nguyen
(74) *Attorney, Agent, or Firm* — Ladas & Parry

(57) ABSTRACT

A method and apparatus for transporting a fluid wherein a pressure difference for causing transport of the fluid to occur is generated by membrane, which may include a network of pores, preferably arranged in artificial leaves, in fluid communication with the fluid and in contact with an environment facilitating vaporization of the fluid via the membrane, the apparatus including a mechanical apparatus for recovering useable energy from the transport of the fluid across the membrane.

33 Claims, 3 Drawing Sheets

(56) References Cited

OTHER PUBLICATIONS

Wheeler and Stroock, "The Transpiration of Water at Negative Pressures in a Synthetic Tree—Supplementary Information"—Nature 10.1038/nature07226.
U.S. Appl. No. 12/783,542, filed May 19, 2010, Roper.
U.S. Appl. No. 12/691,393, filed Jan. 21, 2010, Barvosa-Carter.
U.S. Appl. No. 12/383,378, filed Mar. 23, 2009, Roper.
Chen et al. Polymer-Polymer Nanocomposite Membranes as Breathable Barriers with Electro-Sensitive Permeability. Department of Chemical and Biological Engineering, Drexel University, 2009, pp. 1-16.
Enchanted Learning. Leaves and Leaf Anatomy. pp. 1-5, Oct. 2008. http://www.enchantedlearning.com/subjects/plants/leaf/.
Fiber Source. Cellulose. pp. 1-5, [no date]. http://www.fibersource.com/f-tutor/cellulose.htm.
Meidner. Stomata and Gas Exchange. 1990, pp. 1-26. http://udspace.udel.edu/bitstream/handle/19716/2830/Chapter%208.%20%3Cstrong%3EStomata %3C/strong%3E%20and%20Gas...?sequence=7.
U.S. Appl. No. 12/783,546, Application and Office Actions, including but not limited to the office actions mailed on Sep. 5, 2012; Oct. 24, 2012; and Sep. 9, 2013.
U.S. Appl. No. 12/783,542, Application and Office Actions, including but not limited to the office actions mailed on Apr. 11, 2013 and Sep. 13, 2013.
U.S. Appl. No. 12/691,393, Application and Office Actions.
U.S. Appl. No. 12/383,378, Application and Office Actions.
Carbajal, et al., "Thermal response of a flat heat pipe sandwich structure to a localized heat flux", International Journal of Heat and Mass Transfer, No. 49, (2006), pp. 4070-4081.
Lu, et al., "Active cooling by metallic sandwich structures with periodic cores", Progress in Materials Science, No. 50, (2005), pp. 789-815.
Monro, Tanya M., "Topical review, Catching light in its own trap", Journal of Modern Optics, 2001, vol. 48, No. 2, pp. 191-238.
Queheillalt, et al., "A multifunctional heat pipe sandwich panel structure", International Journal of Heat and Mass Transfer, No. 51, (2008), pp. 312-326.
Tian, et al., "The effects of topology upon fluid-flow and heat-transfer within cellular copper structures", International Journal of Heat and Mass Transfer, Mar. 6, 2004, pp. 1-16.
From U.S. Appl. No. 12/783,546 (unpublished; non publication request filed), office action mailed on Sep. 5, 2012.
From U.S. Appl. No. 12/783,546 (unpublished; non publication request filed), office action mailed on Oct. 24, 2012.
From U.S. Appl. No. 12/783,546 (unpublished; non publication request filed), office action mailed on Sep. 9, 2013.
From U.S. Appl. No. 12/783,546 (unpublished; non publication request filed), office action mailed on Dec. 18, 2013.
From U.S. Appl. No. 12/783,542 (unpublished; non publication request filed), office action mailed on Apr. 11, 2013.
From U.S. Appl. No. 12/783,542 (unpublished; non publication request filed), office action mailed on Sep. 13, 2013.
From U.S. Appl. No. 12/783,542 (unpublished; non publication request filed), office action mailed on Feb. 20, 2014.
Pages 553-555 of vol. 18, 9th ed. The Encyclopedia Britannica by Thomas Spencer (1888).
"Fabricating three dimensional nanostructures using two photon lithography in a single exposure step" by Seokwoo Jeon, Viktor Malyarchuk, John A. Rogers, and Gary P. Wiederrecht published in *Optics Express*, vol. 14, issue 6, at pp. 2300-2308, Mar. 20, 2006.
Wheeler and Stroock "The transpiration of water at negative pressures in a synthetic tree", Nature vol. 455, pp. 208-212 (2008).
U.S. Appl. No. 12/783,546, filed May 19, 2010, Roper.
Fiber Source. Cellulose. pp. 1-5, http://www.fibersource.com/f-tutor/cellulose.htm. Printed: Oct. 22, 2012 (which was cited by the Examiner in an office action dated Oct. 24, 2012 from related U.S. case, U.S. Appl. No. 12/783,546).
Wheeler and Stroock "The transpiration of water at negative pressures in a synthetic tree", Nature vol. 455, pp. 208-212 (2008) published together with "The Transpiration of Water at Negative Pressures in a Synthetic Tree—Supplementary Information"—Nature 10.1038/nature07226 (pp. 1-17).

* cited by examiner

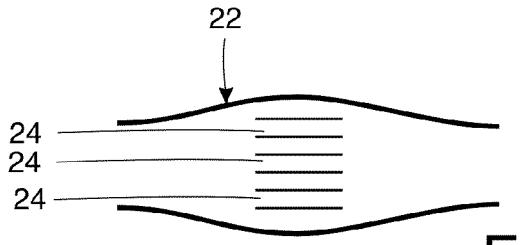
Fig. 3
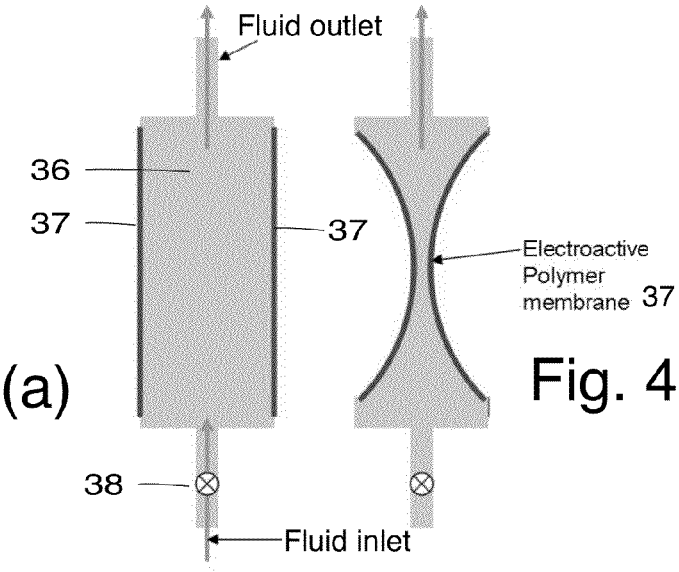
Fig. 4(a)
Fig. 4(b)
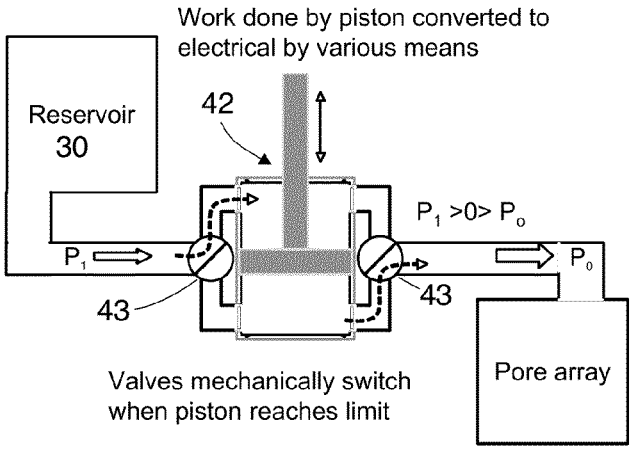
Fig. 5

POWER GENERATION THROUGH ARTIFICIAL TRANSPIRATION

CROSS REFERENCE TO RELATED APPLICATIONS

This application is related to U.S. patent application Ser. No. 12/783,546 filed on the same date as this application and entitled "Artificial Stomata in Artificial Leaves and Methods of Making Artificial Leaves", the disclosure of which is hereby incorporated herein by this reference.

TECHNICAL FIELD

This application relates the use of evaporation to drive high-pressure fluid flow for the generation of energy.

BACKGROUND

Fossil fuel sources (coal, oil, natural gas, LPG, and other hydrocarbons) are burned to generate the majority of electrical power in the world. Burning fossil fuels releases a number of pollutants into the atmosphere that are hazardous:

carbon dioxide is a greenhouse gas and contributes to global warming;

nitrogen oxides (NOx) contribute to smog; and sulfur oxides (SOx) contribute to acid rain.

In addition, the supply of such fuels is finite and the cost of extracting incrementally greater amounts from the earth is accompanied with increasing cost.

Nuclear fission requires fissionable material, the supply of which is also finite. In addition nuclear power generates radioactive waste which is costly to store since it must be located away from human populations, hermetically sealed, and monitored for 100,000s of years.

Hydroelectric power is renewable and has zero emissions; however, moving bodies of water must be dammed to harness this power source. There are a finite number of viable moving bodies of water in the world, most of which are already dammed. In addition, dams hinder the spawning of certain fish species.

Photovoltaics can be used to generate electrical power directly from incident solar radiation; however, it is expensive to manufacture and install large arrays of photovoltaics. The current cost/performance metrics for photovoltaics are not sufficient for large-scale implementation.

Solar-thermal methods require high temperatures to realize high Carnot efficiency. Achieving such high temperatures requires expensive actively controlled light focusing systems.

Other, zero-emission, renewable energy sources, such as wind, wave, and geothermal exist, but are limited to certain geographical regions. Wind power requires high winds, wave power requires substantial waves, tidal power requires large height changes between high and low tide, and geothermal requires a region of high geothermal activity. None of these sources is abundant enough to have the potential to meet the entire current world energy demand, let alone the future world energy demand.

Ground source heat can be a plentiful source of energy, but capital cost of equipment can be high as can be the cost of drilling large bore holes deeply where high-grade heat is located. Less expensive near-surface heat sources provide low grade heat which is not efficiently converted to electrical power.

In addition, some power generation methods require significant amounts of fresh water in the power-generation process.

Schemes have been proposed to use capillary action to elevate water and thus add potential energy to water. These schemes usually propose to use this water to turn a turbine and generate power as the water is decreased in elevation. Such schemes are thermodynamically impossible. (They do not account for the energy required to separate the fluid from the capillary pores once its elevation has been increased.) See page 555 of vol. 18, 9th ed. the Encyclopedia Britannica by Thomas Spencer (1888).

BRIEF DESCRIPTION OF THE INVENTION

In one aspect the present invention provides an apparatus for transporting a fluid wherein a pressure difference for causing transport of the fluid to occur is generated by a membrane, which may include a network of pores, in fluid communication with the fluid and in contact with an environment facilitating vaporization of the fluid via the membrane, the apparatus including an mechanical apparatus for recovering useable energy from the transport of the fluid.

In another aspect the present invention provides a method of generating power comprising: transporting a fluid by a pressure difference generated by a membrane, which may include network of pores, in fluid communication with said fluid and in contact with an environment facilitating vaporization of said fluid via said membrane, and converting transport of said fluid according to said transporting step into useable energy.

In addition or alternatively to generating useable energy, the fluid may be utilized to cool an enclosed space, such as, for example, a building or vehicle utilized by humans.

BRIEF DESCRIPTION OF THE DRAWINGS

FIG. 3 depicts regions within the hierarchical flow channels having multiple parallel flow constrictions which act to limit the spread of air embolisms formed from cavitation events.

FIGS. 4(*a*) and 4(*b*) depict power generation from flow under negative pressure with an electroactive polymer membrane 37 disposed on the walls of a flexible chamber 36.

FIG. 5 depicts the conversion of negative pressure into mechanical work by means of one or more negative-pressure driven pistons.

DETAILED DESCRIPTION

Coastal Redwoods in the state of California, for example, transport water (in the form of sap) through their xylem over 100 m vertically. This occurs through the evaporation of water from the leaves of these trees, which forms a pressure gradient for causing the upward flow of sap in the tree. The sap pressure in most of the tree (anywhere above 10 m) is negative, meaning that the sap is in a state of tension. Cavitation or air embolisms in the xylem can interrupt this process and cause parts of the tree to die due to lack of sap flow and thereby lack of nutrients. These redwoods generate pressures <−1 MPa, which is equivalent in magnitude to a 100 m waterfall.

This biomimetic technology, based on the flow of sap in redwood trees, harnesses power from the pressure gradient and flow of fluid generated from fluid evaporating from a network of pores. Instead of harnessing power from the downward flow of water, as in waterfalls, this invention harnesses power from a different part of the water cycle, the evaporation of water.

Figure 1:
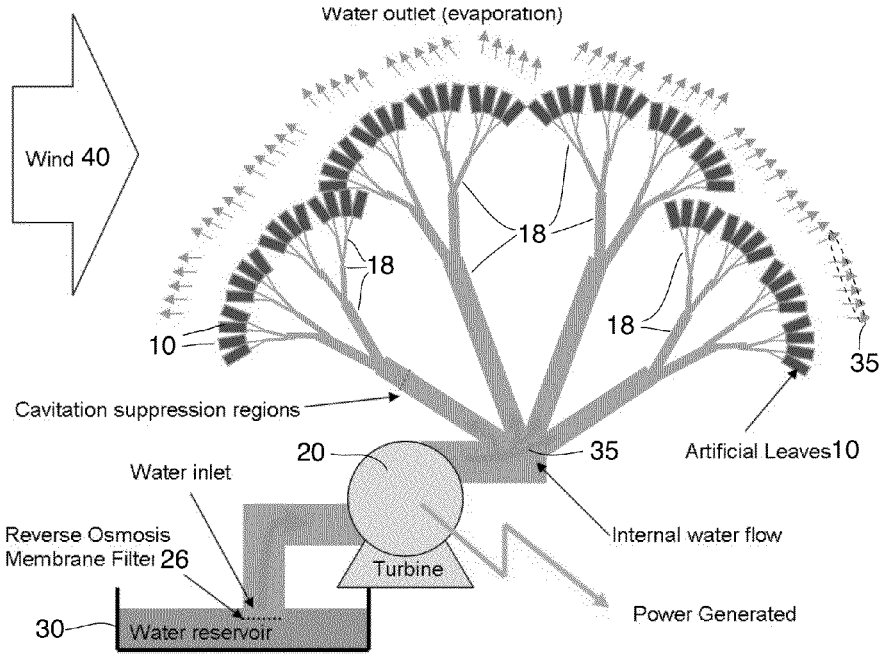
FIG. 1 is a schematic diagram of the general architecture of an artificial transpiration system in accordance with the present invention.

The general architecture of the artificial transpiration system of the present disclosure is depicted in FIG. 1. The important features, when the artificial transpiration system is designed to generate energy, include a porous membrane (which may include tiny pores therein), a hierarchical network of flow channels connecting the porous membrane and a power conversion unit, each of which are discussed in greater detail below.

The Membrane.

A membrane 11 is provided through which a fluid 35, such as water can evaporate to the atmosphere. This membrane 11 can be conventionally porous, having of a network of tiny pores 12 formed therein, in so far as the fluid 35 in channels 14 is concerned. This membrane 11 can alternatively be porous due to its composition, such as a hydrogel or other material which comprises a network of polymer chains that are insoluble in the fluid 35 in channels 14 (which is water in the case of a hydrogel), network of polymer chains being sometimes formed as a colloidal gel wherein the same (or essentially the same) fluid 35 as in the channels 14 is utilized as the dispersion medium of the colloidal gel. Hydrogels are highly absorbent (they can contain over 99% water) natural or synthetic polymers.

The pressure of a liquid state of the fluid 35 on one side of the membrane 11 is less than the pressure of the vapor state of the fluid 35 on the other side of the membrane 11. Greater pressure differences are generally more desirable since they lead to less water being consumed per kW hr of power generated. This pressure difference can be greater than the absolute pressure of the atmosphere to which the fluid is evaporating.

If the membrane is implemented as a porous membrane with tiny pores 12 (see FIG. 2) formed therein, the pores 12 are provided through which a fluid 35, such as water, can evaporate to atmosphere, thereby causing a capillary action to occur. The pores 12 preferably occur in structures such as artificial leaves 10 and, as will be seen, the pores 12 are in fluid communication via flow channels with a power conversion unit 20 which is preferably implemented by a turbine or pump. The pores 12, which may be circularly shaped, preferably have diameters in the range of 100 μm to 0.5 nm. Smaller pores 12 are generally more desirable since they lead to less water being consumed per kW hr of power generated. The leaflike structures 10 and their pores 12 may be manufactured using a number of techniques, including:

- zeolites (larger (>5 nm) zeolite pores are preferred when using water as the fluid)
- 2-photon photopolymerization process
- Wire mesh
- Microlithography
- Sol-gel techniques The pores 12 do not need to be circularly shaped (for instance, narrow channels would generate half of the pressure of circular pores if the channel width was equal to the circular pore diameter). In order to make leaves using the aforementioned "2-photon photopolymerization process," see "Fabricating three-dimensional nanostructures using two photon lithography in a single exposure step" by Seokwoo Jeon, Viktor Malyarchuk, John A. Rogers, and Gary P. Wiederrecht published in *Optics Express*, vol. 14, issue 6, at pages 2300-2308.

Figure 2:
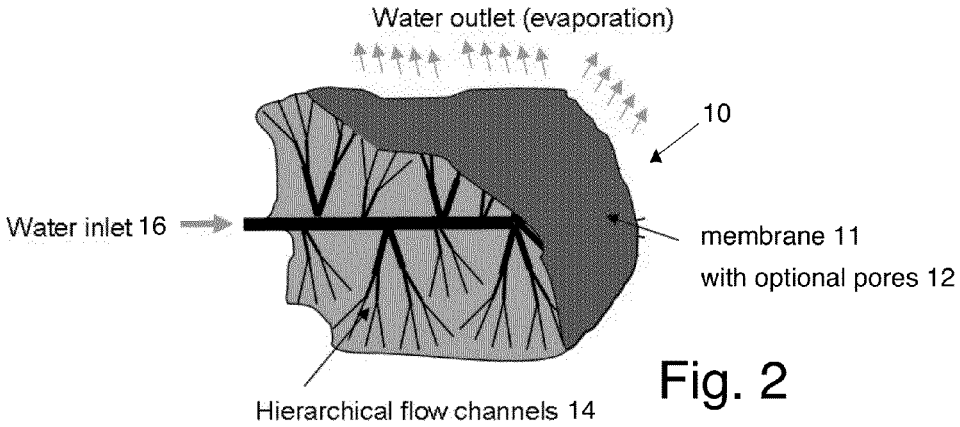
FIG. 2 is a partially cut-away view of an individual artificial leaf showing both the exterior surface of the artificial leaf covered with pores for evaporation and the inside of the artificial leaf with its hierarchical flow channels for fluid delivery to the membrane.
Figure 2B:
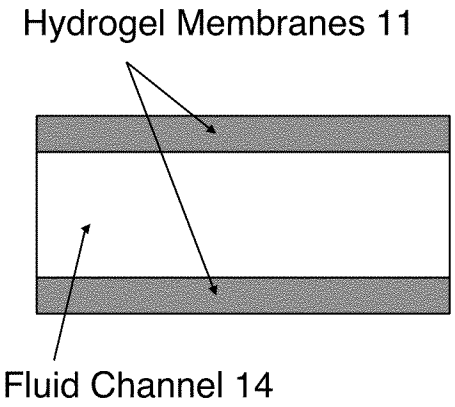
FIG. 2*b* is an exploded view of a small portion of another embodiment of an artificial leaf having major exterior surfaces formed of a porous membrane, the porous membrane comprising a hydrogel material.
Figure 2A:
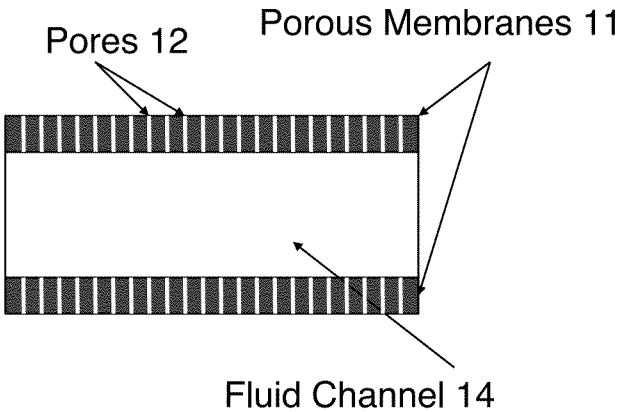
FIG. 2*a* is an exploded view of a small portion of an embodiment of an artificial leaf having major exterior surfaces formed of a porous membrane, the porous membrane having a plurality of small pores formed therein.

A hierarchical network of flow channels connecting the regions of the membrane. The membrane 12 is in fluid communication with the power conversion unit 20 via a hierarchical network of flow channels 14, a portion of which preferably occurs in leaves 10 as shown in FIG. 2. The artificial leaves 10 have a membrane 12 disposed on their exterior surfaces and that membrane 12 is in fluid communication with at least one fluid inlet 16 for the artificial leaf 10 on which the membrane 12 occurs. The artificial leaves 10 are connected at their fluid inlets 16 with another set of (larger diameter) hierarchical flow channels in the limbs 18 and trunk (if any) of this biomimetic entity. It is pressure on the liquid side of the membrane 12 which causes fluid 35 to flow in the network of flow channels 14.

Many artificial leaves 10 can be arrayed to mimic a squat tree or bush and will lead to larger areas for evaporation and thus greater power generation per area of land usage. A squat tree or bush architecture or perhaps a ground cover type configuration would be preferable so that undue pressure is not lost in trying to elevate water from the water source 30 to membrane 11 in the leaves 10 located above the water source 30. And being close to the ground makes the biomimetic "tree" easier to engineer in terms of its structural aspects. Of course, the water reservoir 30 can be located above some or all of the artificial leaves 10 if such a design is practical. For example, the water reservoir 30 could be located in the mountains and the water 35 could flow down hill to the turbine 20 much like a conventional hydroelectric plant, but instead of simply discharging the water exiting the turbine 20 back into a stream, as done with conventional hydroelectric plants (and particularly those having a plurality of turbines), some or all of the water exiting turbine(s) 20 would be subjected to additional pressure generated by the pores 12 thereby applying additional rotational force to the affected turbine(s) 20.

The flow channels in both the leaves 10 and in the limbs 18 and trunk (if any) should preferably have smooth interior walls to: (i) reduce pressure loss due to friction (to thereby maximize power output) and (ii) reduce cavitation events, by reducing the number of sites for heterogeneous cavitation events. The flow channels in the artificial leaves 10 may be fabricated using a microfabicated mold (like many microfluidic devices).

Laminar fluid flow should preferably occur in all regions of the hierarchical network of flow channels 14 is preferred to prevent the occurrence of local high velocity flow (which can lead to cavitation from turbulent flow).

The diameter or flow area of the constrictions 24 should be small enough to resist the pressure exerted by the rest of the system and/or from gravity on the water. This will stop the spread of an air embolism via capillary action. The regions should be of a relatively short length (preferably less than ten times the diameter of an individual flow constriction in this embodiment) so as to not lead to unnecessarily large pressure drops due to frictional losses. The parallel constrictions should be sufficiently numerous not increase flow velocity significantly (since increased flow velocity could lead to lower pressure and higher chance of cavitation events), and therefore the pipe of other fluid channel 22 in which the constrictions 24 are located may be provided with a slight bulge around the parallel-arranged constrictions 24 in order to maintain a more or less constant flow area upstream of the constrictions 24, downstream of the constrictions 24 and through the region of the constrictions 24. These regions where the constructions 24 occur should preferably be situated at multiple places in the system and at multiple flow channel hierarchy levels to prevent the spread of air embolisms. The constrictions 24 may be fabricated with microfabrication techniques and polymer molding (like microfluidic devices).

Power Conversion Unit.

Fluid 35 flows through power conversion unit 20 due to the fluid 35 evaporating through the membrane 11 in leaves 10. Preferably the power conversion unit 20 when implemented by a pump or turbine can be run in reverse (when powered by electrical energy for example) to prime the system with fluid 35 initially or to re-prime it after repairs and/or a cavitation/air-embolism event. During normal system operation, the power conversion unit 20 drives a generator for providing electrical current energy in response to the upward movement of the fluid in the channels in the limbs of the system.

If the power conversion unit 20 is embodied as a turbine, it preferably is not an impulse turbine since exposure to air would induce cavitation. A reaction turbine would be better suited to this application. And in any event, a slow moving turbine would be preferred to reduce cavitation incidents.

The power conversion unit 20 may be embodied (i) as a dielectric elastomer (see FIGS. 4(*a*) and 4(*b*)); (ii) as a Tesla turbine; (iii) by negative-pressure driven pistons (see FIG. 5); or (iv) by using positive displacement methods (i.e. positive displacement pump running in reverse). A non-exclusive list of positive displacement pumps would include: gear pumps, cavity pump, roots-type pumps, gerotors, reciprocating-type pumps, multiple-diaphragm pumps, and peristaltic pumps. The pumps are preferably not just taken off the shelf and run in reverse, but should preferably be designed to optimize efficient power conversion.

FIGS. 4(*a*) and 4(*b*) depict power generation from flow under negative pressure with an electro-active polymer (EAP) membrane 37 disposed on the walls of a flexible chamber 36. FIG. 4(*a*) shows a valve 38 disposed preferably at or near an inlet to the chamber 36 in an open position. With fluid 35 flowing through system, and chamber 36 fills with fluid 35. The chamber walls (formed of a dielectric polymer) have a voltage applied across their thickness (to create a capacitor). FIG. 4(*b*) shows the valve 38 closed, the pressure differential pulls water out of chamber 36, deflecting chamber walls and increasing the capacitance of the walls. By cycling between the fluid filled state of FIG. 4(*a*) and the fluid depleted state of FIG. 4(*b*) power can be generated from the cyclic change in capacitance of the walls (using current rectifiers). The system should preferably be designed (geometry and cycle frequency) such that the elastic restoring force of the bent chamber walls does not cause cavitation upon chamber refilling with fluid.

FIG. 5 depicts the conversion of negative pressure into mechanical work by means of one or more negative-pressure driven pistons 42. Switchable valves 43 allow fluid 35 into/out of opposite sides of a dual-action piston 42, causing the piston 42 to move. Valve switching can be powered or unpowered depending on desired mode of operation. Power generation is accomplished by various means due to piston motion, either linear or rotary.

If the power conversion unit 20 (*i*) cannot or (ii) is not suitable to be run in reverse to prime (or re-prime) the system, then a separate priming pump may be utilized for that purpose.

A filtration membrane filter (preferably a reverse osmosis filtration membrane filter) 26 is preferably employed at or near the input to the power conversion unit 20 (and the optional priming pump) to remove dissolved impurities from the source water 30 thereby yielding fresh, purified water for the system without the need for a separate purification stage/mechanism. Alternatively, the source of water 30 should provide water with a very low dissolved mineral content. If the source of water for the membrane 11 is not substantially mineral free, the dissolved minerals therein will come out of solution at the membrane 11 or at pores 12 therein (if a conventional porous membrane is utilized) and thus tend to occlude either the pores 12 or the regions between the network of polymer chains (if a hydrogel or a similar material is utilized) when evaporation occurs. If an in-line filter 26 is utilized, then it will reduce some of the available pressure drop otherwise for power generation. It is preferred to use water with as low a dissolved mineral content as reasonably possible to minimize the pressure drop across the filtration membrane. Other fluids 35 than water will work from a fluid mechanics view point, but most other fluids would have to be isolated from the environment. So water is the preferred fluid 35.

The fluid 35 is preferably purified water since evaporation will tend to lead to deposition of any dissolved impurities at either the pores 12 (if a conventional porous membrane is utilized) or in the network of polymer chains (if a hydrogel or similar material is utilized) which would occlude the pores 12 and/or the membrane 11 and reduce the lifetime of the device or at least increase the amount of maintenance required to maintain fluid flow through the membrane 11.

The artificial transpiration system provides a method of extracting power from the pressurized water flow where the power generated=$\eta v \Delta P$ (efficiency X volumetric flow rate X pressure drop). The artificial transpiration system should preferably be situated in a place with (a) Wind 40 of having a relatively high average and consistent velocity;

(b) Wind 40 of having a relatively low humidity;

(c) Wind 40 of having a relatively high ambient temperature;

(d) An ample supply of liquid water 35 for reservoir 30.

A 0.1 MPa pressure drop with 200,000 artificial leaves (each having an evaporation area of 0.01 $m^2$) would generate 150 W if in the mass transfer limited regime at 6 m/s wind speed at 25° C.

A 1.1 MPa pressure drop with 200,000 artificial leaves (each having an evaporation area of 0.01 $m^2$) would generate 1.7 kW if in the mass transfer limited regime at 6 m/s wind speed at 25° C.

An 80 MPa pressure drop with 200,000 artificial leaves (each having an evaporation area of 0.01 $m^2$) would generate 125 kW if in the mass transfer limited regime at 6 m/s wind speed at 25° C.

There are a number of possible limitations to the performance of this technology (i.e limiting the maximum power generated):

1. The flow of water will either be heat transfer limited or mass transfer limited:

a. If heat transfer limited, the temperature of the system will drop to a point where the input heat is equal to the heat of vaporization of water times the mass flow rate.

b. If mass transfer limited, the total flow rate will be equal to the maximum mass transfer rate of water vapor from the artificial leaves. In this case, the flow rate of water will be positively correlated with total area of the membrane 11 over the totality of the number of artificial leaves utilized.

2. The disclosed system could be physically damaged resulting in a hole which leads to the formation of an air embolism which will block fluid flow; however, the air embolism suppression regions of FIG. 3 are intended to prevent such embolisms from spreading.

In order to minimize cavitation the possibility of cavitation events, a plurality of power conversion units 20 may be employed which are preferably distributed throughout the disclosed system. For example, the plurality of power conversion units 20 may be located close to the leaves 12 to minimize the amount of fluid under negative pressure and thereby minimize the regions of the system subject to possible cavitation events.

There are many possible variations to the embodiments described above. For example, another fluid besides water could be used. On the other hand, water is widely available, non-toxic, and has a large surface tension (a fluid having a large surface tension is highly desirable since it is less likely to cavitate). Additives may be added to the fluid 35 to reduce the probability of cavitation if desired.

A micro-truss developed by HRL Laboratories of Malibu, Calif. may be utilized to make stiff leaves with low resistance to fluid flow. See U.S. Pat. No. 7,382,959 to Jacobsen entitled "Optically oriented three-dimensional polymer microstructures".

Fluid 35 may be actively heated to enhance the evaporation rate, and if that is done, such heating could come from a low grade heat source (such as ground source heat) or by using passive techniques to focus the sun's energy on the artificial leaves 12. Pressure exchangers may be used to convert one stream of high negative pressure into multiple streams at 0.1 MPa difference to reduce cavitation in the power generation portion of the disclosed system.

The disclosed system may be modified to be used in an enclosed system such as a heat pipe, loop heat pipe, or thermo-syphon to generate power from a heat flow between two temperature baths.

Instead of using single large diameter channels in the flow paths in the limbs 18 (for example), the flow channels may comprise instead multiple narrow or small diameter parallel flow channels thereby providing redundancy in case of failure of one of more of the flow channels. However, a downside of using multiple parallel channels is that this technique will require a greater overall cross-sectional area of the flow paths (due to the flow resistance caused by the increased wall surface area per unit volume of flow path) and thus this technique will tend to exhibit greater pressure drop per unit length of flow channel.

Check valves may be disposed between series and/or parallel channels that either (a) allow fluid 35 to flow only in an intended direction or (b) do not allow the flow of atmospheric pressure air (using the pressure difference between negative absolute pressure liquid and positive absolute pressure air to shut the check valve).

Existing natural plants and natural plant parts may be used to comprise or fabricate part of the disclosed system. For example, one could cut off one or more limbs from a living plant (with associated leaves), form a seal to the base of the limb to the power generation unit, and use the natural transpiration process of the plant to generate the required pressure drop and liquid flow. But this may only function for a few days until the leaves died. But one could fertilize the system to provide nutrients to the leaves of the natural plant to increase longevity. One would replace the old plant parts with new plant parts after the old plant parts wilt or die. An embodiment with natural plant parts is especially suited for mobile, remote power generation, since the mass and size of the components that do need transported is much less than for designs with artificial leaves (since components can instead be harvested from the local environment). One could cut a branch of a natural tree and seal a power generating device to both exposed sides after the cut is made. This could provide power for a sensor node and aid in preventing and recovering from air-embolisms during the cutting and installation of the cut tree. In this connection:

i. One could re-prime the limbs and leaves after sealing by pumping liquid or by running the power generation system in reverse to start;

ii. One could re-prime lines with gravity driven flow if branches were angled downward; and iii. One could do the cutting and installation in a water (or other liquid) bath.

An alternate method of generating power would be to use some (or all) of the generated pressure drop to perform reverse osmosis on a portion of a stream of fluid (e.g. a river). That portion of the stream would become enriched in dissolved species. The enriched stream could be mixed with the remainder of the stream and energy could be generated from the energy of mixing.

The disclosed system could be utilized to increase humidity in a geographic region (for example in desert regions). The system could be used in conjunction with geological features, such as mountains, to bring rain to dry places (i.e. mitigate drought conditions and/or water crops).

The primary purpose of artificial transpiration disclosed herein is to generate electrical power. However, the disclosed structure used to generate power can also be used in a dynamic power generation/cooling mode for multifunctional structural applications. For instance, the membrane may be formed, if desired, on the surface of a vehicle. The hierarchical flow channel structure could be formed in the skin or frame of the vehicle to feed water to the external pore structure from a central reservoir. This reservoir could be fed variously by filling by the user, run-off collected from condensation on the vehicle air-conditioning, or condensed water vapor from a fuel cell power source. The system could be configured such that the transpiration structure can generate full power, partial power and partial cooling, or full cooling from the same structure. The power needed to otherwise cool a vehicle could be reduced, thereby lowering harmful emissions of the vehicle.

It should be understood that the above-described embodiments are merely some possible examples of implementation, set forth for a clear understanding of the principles of the disclosure. Many variations and modifications, in addition to or supplementing those discussed above, may be made to the above-described embodiments of the invention without departing substantially from the principles of the invention as disclosed herein. All such modifications and variations are intended (i) to be included herein within the scope of this disclosure and the present invention and (ii) to be protected by the following claims.

What is claimed is:

1. An apparatus for transporting a fluid wherein a pressure difference for causing transport of said fluid to occur is generated by a membrane in fluid communication with said fluid and in contact with an environment facilitating vaporization of said fluid via said membrane, the apparatus including a power conversion unit for producing useable energy in the form of electricity from said transport of said fluid, said membrane being in fluid communication with and downstream of said power conversion unit.

2. The apparatus of claim 1 wherein the fluid is selected from the group consisting of water, acetone, ethanol, ammonia, mercury, methanol, Flutec PP2, heptane, Flutec PP9, pentance, small chain hydrocarbons (C<10), small chain alcohols (C<8), and halogenated hydrocarbons.

3. The apparatus of claim 1 wherein the power conversion unit comprises a pump.

4. The apparatus of claim 1 wherein the power conversion unit comprises a reactive turbine.

5. The apparatus of claim 1 wherein the fluid is filtered, preferably via reverse osmosis, prior to application to said membrane.

6. The apparatus of claim 1 wherein the fluid flows through hierarchically arranged channels from said power conversion unit to said membrane.

7. The apparatus of claim 6 wherein the channels include regions for preventing spread of air embolisms in said channels.

8. The apparatus of claim 1 wherein the transport of said fluid occurs in channels which include regions for preventing spread of air embolisms in said channels.

9. The apparatus of claim 1 wherein said membrane is disposed on an exterior surface of a plurality of artificial leaves exposed to said environment.

10. The apparatus of claim 9 wherein said environment is the earth's atmosphere.

11. The apparatus of claim 1 wherein the membrane comprises a hydrogel.

12. The apparatus of claim 1 wherein the membrane comprises a porous membrane with a plurality of pores formed therein.

13. A method of generating power comprising:

transporting a fluid by a pressure difference generated across a membrane in fluid communication with said fluid and in contact with an environment for facilitating vaporization of said fluid via said membrane to said environment, and converting transport of said fluid according to said transporting step into useable electrical energy at a power conversion unit in fluid communication with and upstream of said membrane.

14. The method of claim 13 wherein the fluid is selected from the group consisting of water, acetone, ethanol, ammonia, mercury, methanol, Flutec PP2, heptane, Flutec PP9, pentance, small chain hydrocarbons (C<10), small chain alcohols (C<8), and halogenated hydrocarbons.

15. The method of claim 13 wherein a positive displacement pump is utilized to convert the transport of said fluid, according to said transporting step, into said useable electrical energy.

16. The method of claim 13 wherein a reactive turbine is utilized to convert the transport of said fluid, according to said transporting step, into said useable electrical energy.

17. The method of claim 13 wherein the fluid flows through hierarchically arranged channels from said reactive turbine to said membrane, the fluid flowing under negative pressure during at least a portion of time while flowing said hierarchically arranged channels.

18. The method of claim 13 further including a step of filtering the fluid via reverse osmosis prior to application to said membrane.

19. The method of claim 18 wherein the channels include regions for preventing spread of air embolisms in said channels.

20. The method of claim 13 wherein said membrane is arranged in a plurality of artificial leaves exposed to said environment.

21. The method of claim 20 wherein said environment is the earth's atmosphere.

22. The method of claim 13 wherein the converting the transport of said fluid into useable electrical energy is effected at least in part by the utilization of one or more flexible chambers, each flexible chamber having an electroactive polymer (EAP) membrane disposed on the walls of the flexible chamber, and an associated valve in fluid communication with an inlet to the flexible chamber, the associated valve being in an open position when fluid flows through system allowing the flexible chamber to fill with fluid, the associated valve being closed thereby allowing a pressure differential to pull fluid out of chamber, thereby deflecting walls of the flexible chamber.

23. The apparatus of claim 1 wherein the fluid is transported from a reservoir for storing said fluid to first said power conversion unit and thence to said membrane, said power conversion unit being in direct fluid communication with both said reservoir and with said membrane.

24. The apparatus of claim 23 wherein said reservoir is disposed at a relatively higher elevation than said power conversion unit which is disposed at a relatively lower elevation, whereby the power conversion unit produces useable energy in the form of electricity (i) from said transport occurring due to said membrane and (ii) from said fluid flowing from said reservoir at said relatively higher elevation to said power conversion unit at said relatively lower elevation.

25. The apparatus of claim 1 wherein the fluid is selected from the group consisting of organic compounds of acetone, ethanol, ammonia, mercury, methanol, Flutec PP2, heptane, Flutec PP9, pentance, small chain hydrocarbons (C<10), small chain alcohols (C<8), and halogenated hydrocarbons.

26. The apparatus of claim 1 wherein said membrane comprises a plurality of membranes disposed in a plurality of artificial leaves disposed on one or more artificial trees.

27. The apparatus of claim 1 wherein the power conversion unit comprises a positive displacement pump running in reverse so that the positive displacement pump is caused to move in response to a negative pressure asserted thereon by said fluid.

28. The method of claim 13 wherein the fluid is transported from a reservoir for storing said fluid to first a power conversion unit and thence to said membrane, said power conversion unit being in direct fluid communication with both said reservoir and with said membrane, said power conversion unit converting the transport of said fluid according to said transporting step into said useable electrical energy.

29. The method of claim 28 further including the steps of disposing said reservoir at a relatively higher elevation than said power conversion unit which is disposed at a relatively lower elevation, allowing said fluid to flow from said reservoir to said power conversion unit whereby the flow of said fluid to said the power conversion unit produces additional useable energy in the form of electricity, said additional useable energy being in addition to the useful electrical energy produced from said transport occurring due occur due to said membrane.

30. The method of claim 13 wherein said membrane comprises a plurality of membranes disposed in a plurality of artificial leaves.

31. The method of claim 13 wherein the power conversion unit comprises a positive displacement pump running in reverse so that the positive displacement pump is moves in response to a negative pressure asserted thereon by said fluid.

32. An energy generating apparatus comprising:

(i) a reservoir of a fluid;

(ii) a power conversion unit, in fluid communication with said reservoir, for producing useable energy in the form of electricity from movement of said fluid through said power conversion unit; and (iii) at least one membrane in fluid communication with fluid exiting said power conversion unit and in contact with an environment facilitating vaporization of said fluid via said membrane, said at least one membrane applying tension to the fluid exiting said power conversion unit to thereby at least assist in said movement of said fluid through said power conversion unit.

33. The apparatus of claim 28 wherein said reservoir is disposed at a relatively higher elevation than said power conversion unit which is disposed at a relatively lower elevation, whereby the power conversion unit produces useable energy in the form of electricity (i) from said tension occurring due occur due to said membrane and (ii) from said liquid flowing from said reservoir at said relatively higher elevation to said power conversion unit at said relatively lower elevation.

* * * * *